US009789503B2

(12) United States Patent
Tada

(10) Patent No.: US 9,789,503 B2
(45) Date of Patent: Oct. 17, 2017

(54) TRIGGER-TYPE PUMP DISPENSER

(71) Applicants: CANYON CORPORATION, Sanyo Onoda-shi, Yamaguchi (JP); Mieko Tada

(72) Inventor: Tetsuya Tada, Tokyo (JP)

(73) Assignee: CANYON CORPORATION, Sanyo Onoda-shi, Yamaguchi (JP)

( * ) Notice: Subject to any disclaimer, the term of this patent is extended or adjusted under 35 U.S.C. 154(b) by 0 days.

(21) Appl. No.: 14/915,748

(22) PCT Filed: Sep. 5, 2014

(86) PCT No.: PCT/JP2014/004576
§ 371 (c)(1),
(2) Date: Mar. 1, 2016

(87) PCT Pub. No.: WO2015/033573
PCT Pub. Date: Mar. 12, 2015

(65) Prior Publication Data

US 2016/0193617 A1 Jul. 7, 2016

(30) Foreign Application Priority Data

Sep. 6, 2013 (JP) ..... 2013-185763

(51) Int. Cl.
*B05B 11/00* (2006.01)

(52) U.S. Cl.
CPC ..... *B05B 11/3014* (2013.01); *B05B 11/0008* (2013.01); *B05B 11/0067* (2013.01);
(Continued)

(58) Field of Classification Search
CPC ..... B05B 11/3014; B05B 11/0008; B05B 11/0067; B05B 11/3012; B05B 11/3022;
(Continued)

(56) References Cited

U.S. PATENT DOCUMENTS 1,937,344 A 11/1933 Hollingsworth
4,124,148 A * 11/1978 Vieler ..... B05B 11/3057 222/3
(Continued)

FOREIGN PATENT DOCUMENTS

JP 2008-087808 A 4/2008
JP 2008087808 A * 4/2008
(Continued)

OTHER PUBLICATIONS

English translation of International Search Report for PCT/JP2014/004576.
Extended European search report dated Mar. 14, 2017 for application No. 14842023.

*Primary Examiner* — Donnell Long
(74) *Attorney, Agent, or Firm* — Muncy, Geissler, Olds & Lowe, P.C.

(57) ABSTRACT

[Object] To provide a trigger-type pump dispenser A which is configured such that a trigger section 13 is depressed by a thumb with a handle gripped, which is good in grippability, which allows efficient transmission of finger pressure to the trigger section 13 during spraying, and which is excellent in operation.
[Solution] The present invention is directed to a trigger-type pump dispenser including: a cylinder section; a handle section 12; a trigger section 13 located above the handle section 12; and a nozzle section 4 from which liquid is sprayed out of the cylinder section by depressing the trigger section 13 with the handle section 12 gripped, wherein the handle section 12 has a finger contact portion S located posterior to a point of force of the trigger section 13.

7 Claims, 13 Drawing Sheets

(52) U.S. Cl.
CPC ..... *B05B 11/3012* (2013.01); *B05B 11/3022* (2013.01); *B05B 11/3038* (2013.01); *B05B 11/3057* (2013.01); *B05B 11/3073* (2013.01); *B05B 11/3074* (2013.01)

(58) Field of Classification Search
CPC ..... B05B 11/3057; B05B 11/3073; B05B 11/3074; B05B 11/3038
USPC ..... 222/473, 470, 323, 324, 321.8, 383.3
See application file for complete search history.

(56) References Cited

U.S. PATENT DOCUMENTS

| | | | | |
|---|---|---|---|---|
| 4,186,855 | A * | 2/1980 | Edman | B05B 11/3057 222/321.8 |
| 6,290,100 | B1 | 9/2001 | Yacko et al. | |
| 2011/0284578 | A1* | 11/2011 | Wong | A47G 19/183 222/40 |
| 2014/0061252 | A1* | 3/2014 | Sweeton | B05B 11/0037 222/321.8 |

FOREIGN PATENT DOCUMENTS

| | | | |
|---|---|---|---|
| JP | 2008-200624 | A | 9/2008 |
| JP | 2008-229445 | A | 10/2008 |
| JP | 2010-184182 | A | 8/2010 |
| JP | 2012-176379 | A | 9/2012 |

* cited by examiner

FIG.7

| Angle θ | 1 | 2 | 3 | 4 | 5 | 6 | 7 | 8 | 9 | 10 | 11 | 12 |
|---|---|---|---|---|---|---|---|---|---|---|---|---|
| ◎ | 7 | 11 | 15 | 20 | 18 | 16 | 17 | 16 | 15 | 13 | 10 | 8 |
| ○ | 10 | 10 | 12 | 13 | 12 | 13 | 12 | 13 | 12 | 12 | 8 | 8 |
| △ | 8 | 10 | 6 | 5 | 5 | 7 | 5 | 7 | 9 | 8 | 10 | 12 |
| □ | 12 | 8 | 6 | 3 | 5 | 4 | 6 | 4 | 5 | 7 | 11 | 10 |
| × | 16 | 4 | 4 | 2 | 3 | 3 | 3 | 3 | 2 | 3 | 4 | 5 |

◎ : Easy to operate
○ : Slightly easy to operate
△ : Hard to say whether it is easy or difficult to operate
□ : Slightly difficult to operate
× : Difficult to operate

FIG.9

| | A | B | C |
|---|---|---|---|
| ◎ | 22 | 15 | 8 |
| ○ | 11 | 10 | 8 |
| △ | 6 | 8 | 13 |
| □ | 3 | 7 | 8 |
| × | 1 | 3 | 6 |

◎ : Easy to operate
○ : Slightly easy to operate
△ : Hard to say whether it is easy or difficult to operate
□ : Slightly difficult to operate
× : Difficult to operate

TRIGGER-TYPE PUMP DISPENSER

TECHNICAL FIELD

The present invention relates to pump dispensers that are attached to containers to efficiently spray liquid out of the containers and, more particularly, to a trigger-type pump dispenser that is easy to grip and capable of efficiently transmitting finger pressure to a trigger section.

BACKGROUND ART

Currently, pump dispensers are widely used as tools that are attached to containers to eject or spray liquid out of the containers.

Such a pump dispenser normally includes a piston and a cylinder, and moving the piston applies pressure into the cylinder to cause the liquid to be sprayed.

These pump dispensers are divided into types according to how their pistons are moved, and one of the types is a trigger-type pump dispenser whose trigger is squeezed with four fingers (see Patent Literatures 1 and 2).

The trigger-type pump dispenser has a forward-mounted actuating lever that corresponds to a trigger. Gripping the lever by hand and moving it toward a near side causes the piston, which is disposed in a horizontal direction, to move in tandem with the lever to raise the pressure of liquid in the cylinder.

This in turn causes the liquid to be quickly sprayed out from a nozzle.

CITATION LIST

Patent Literature

PTL 1: Japanese Patent Application Laid-Open No. 2008-229445

PTL 2: Japanese Patent Application Laid-Open No. 2012-176379

PTL 3: Japanese Patent Application Laid-Open No. 2010-184182

SUMMARY OF INVENTION

Technical Problem

Incidentally, in squeezing the trigger of such a trigger-type pump dispenser, it is necessary to grip the entire periphery of the trigger-type pump dispenser with the palm of a hand and squeeze the trigger crosswise with fingers.

This makes it difficult for children with small hands and disabled people with a weaker grip or lower finger pressure to put any muscle in handling the trigger-type pump dispenser, as they can only shallowly grip the trigger.

Further, gripping the whole trigger-type pump dispenser with four (or, for some people, two or three) fingers may undesirably cause the hand to be soiled with a liquid chemical or the like, if any, adhering to the periphery of the pump dispenser's body.

In particular, a finger located directly below the nozzle easily gets soiled.

In order to solve such problems, the inventor of the present invention developed a trigger-type pump dispenser structured such that a handle provided directly below a trigger makes it possible to grip the trigger and the handle at the same time and depress the trigger downward (see Patent Literature 3).

The trigger-type pump dispenser is operated with the backward-mounted handle section supported by four fingers and the trigger supported by the thumb. As such, the trigger-type pump dispenser can be used with the thumb straightened upward. Therefore, the trigger-type pump dispenser is excellent in operability.

Therefore, the trigger-type pump dispenser is easy for even children and others to handle and therefore extremely useful.

However, from an ergonomic perspective, there is a demand for a trigger-type pump dispenser that is easier to use from the viewpoint of grippability.

The present invention has been made on the basis of the background art to overcome the problems associated with the background art.

That is, it is an object of the present invention to provide a trigger-type pump dispenser which is configured such that a trigger section is depressed by the thumb with a handle section gripped, which is good in grippability, which allows efficient transmission of finger pressure to the trigger section during spraying, and which is excellent in operation.

Solution to Problems

The inventor of the present invention diligently studied in order to solve the problems described above. As a result, by focusing attention on the shapes of a trigger section and a handle section and their mutual positional relationship, the inventor found that a further improvement in operability can be achieved. On the basis of this finding, the inventor accomplished the present invention.

The present invention is directed to (1) a trigger-type pump dispenser including: a cylinder section; a handle section; a trigger section located above the handle section; and a nozzle section from which liquid is sprayed out of the cylinder section by depressing the trigger section with the handle section gripped, wherein the handle section has a finger contact portion located posterior to a point of force of the trigger section.

The present invention is directed to (2) the trigger-type pump dispenser according to (1), wherein the finger contact portion of the handle section has an angle of inclination of 3 degrees to 10 degrees.

The present invention is directed to (3) the trigger-type pump dispenser according to (1) or (2), wherein the handle section and the trigger section are placed at a distance of 35 to 45 mm from each other.

The present invention is directed to (4) the trigger-type pump dispenser according to (1), including: a cylinder structure; a piston structure that freely slides in the cylinder section; a nozzle base section; the nozzle section; and a cap section, wherein the cylinder structure integrally includes the cylinder section, the trigger section, and the handle section, the piston structure integrally includes a piston section, a support section, and a plate spring section, and by depressing the trigger section toward the handle section, the piston section is depressed to apply pressure into the cylinder section to eject liquid through the nozzle section.

The present invention is directed to (5) a container-equipped trigger-type pump dispenser including: a container provided with a handle section; a cylinder section; a trigger section located above the handle section; and a nozzle section from which liquid is sprayed out of the cylinder section by depressing the trigger section with the handle section gripped, wherein the handle section has a finger contact portion located posterior to a point of force of the trigger section.

The present invention is directed to (6) the container-equipped trigger-type pump dispenser according to (5), wherein the finger contact portion of the handle section has an angle of inclination of 3 degrees to 10 degrees.

The present invention is directed to (7) the container-equipped trigger-type pump dispenser according to (5), including: a cylinder structure; a piston structure that freely slides in the cylinder section; a nozzle base section; the nozzle section; and a cap section, wherein the cylinder structure integrally includes the cylinder section and the trigger section, the piston structure integrally includes a piston section, a support section, and a plate spring section, and by depressing the trigger section toward the handle section, the piston section is depressed to apply pressure into the cylinder section to eject liquid through the nozzle section.

It should be noted that it is possible to employ a configuration of a proper combination of (1) to (7), provided such a configuration is directed toward a purpose of the present invention.

Advantageous Effects of Invention

The present invention is directed to a trigger-type pump dispenser including: a cylinder section; a handle section; a trigger section located above the handle section; and a nozzle section from which liquid is sprayed out of the cylinder section by depressing the trigger section with the handle section gripped, wherein the handle section has a finger contact portion located posterior to a point of force of the trigger section. The trigger-type pump dispenser is easy to grip, high in retentivity, and excellent in operability.

As such, the present invention is also applicable to a trigger-type pump dispenser whose container has a heavy load.

BRIEF DESCRIPTION OF DRAWINGS

FIG. 7 shows the results of Experiment 1.

FIG. 9 shows the results of Experiment 2.

DESCRIPTION OF EMBODIMENTS

Figure 1:
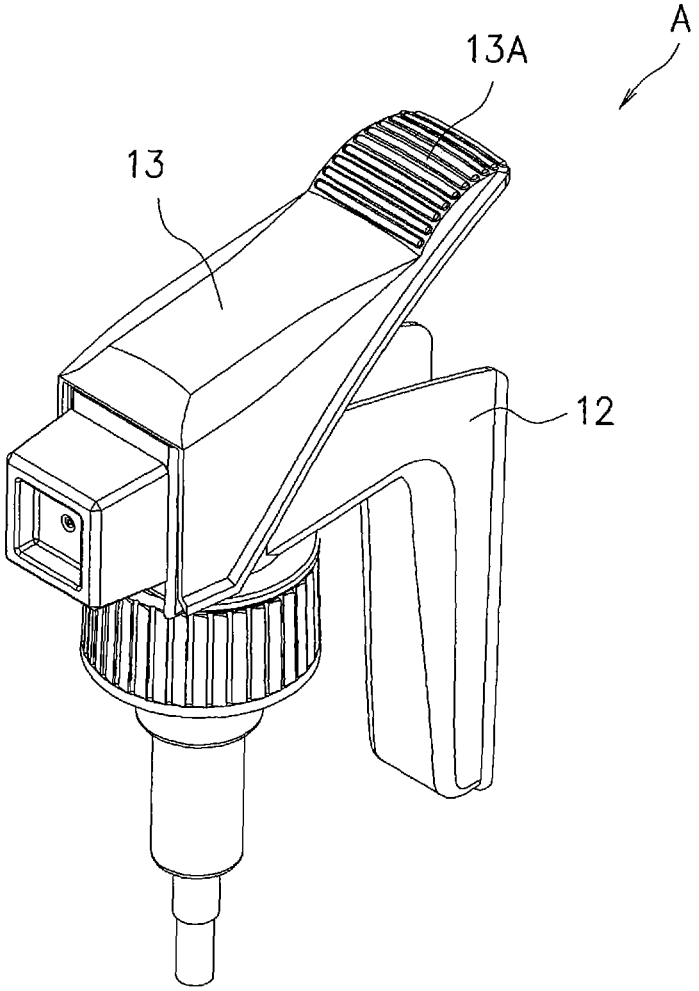
FIG. 1 is a perspective view of a trigger-type pump dispenser of the present invention.

A preferred embodiment of the present invention is described in detail below with reference to the drawings as needed.

In the drawings, the same components are given the same reference signs, and repetition of the same descriptions is omitted.

Further, unless otherwise noted, positional relationships such as top and bottom, left and right are based on those shown in the drawings.

Furthermore, the dimensional ratios of the drawings are not limited to those shown in the drawings.

First Embodiment

A trigger-type pump dispenser A of the present invention is structured such that by gripping a handle section 12 and depressing (i.e., pulling down) a trigger section 13 downward with fingers, a piston section 21 is moved down to apply compressive force to liquid so that the liquid is sprayed from a nozzle section 4.

Figure 2:
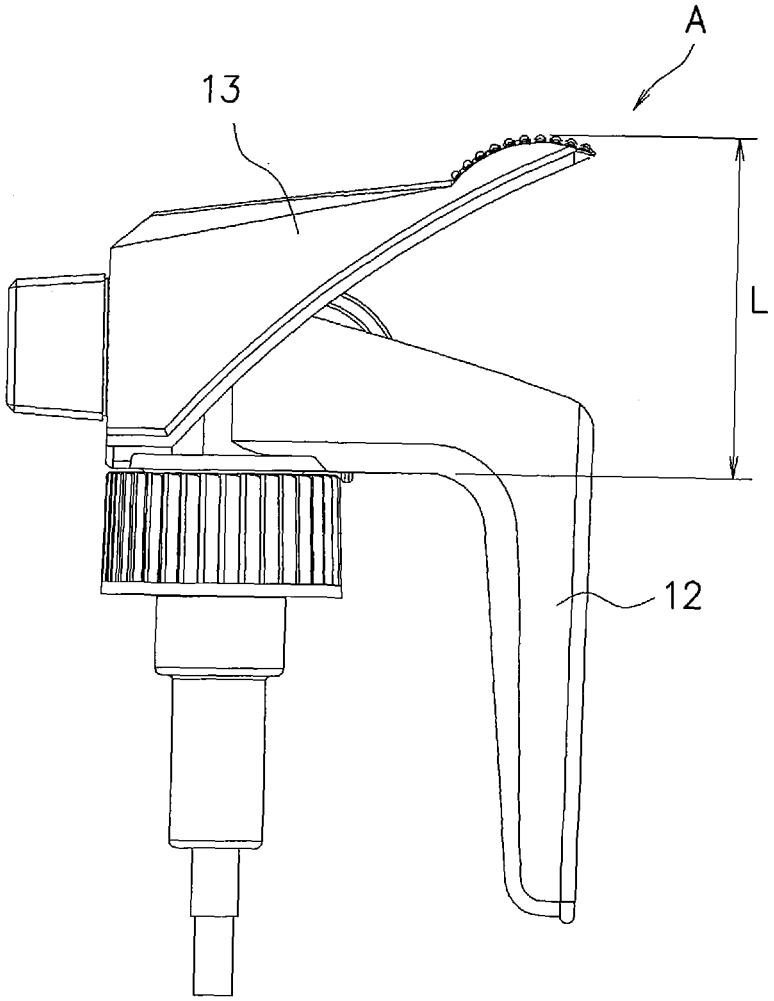
FIG. 2 is a side view of the trigger-type pump dispenser of the present invention.

FIG. 1 is a perspective view of a trigger-type pump dispenser of the present invention, and FIG. 2 is a side view of the trigger-type pump dispenser of the present invention.

Figure 3:
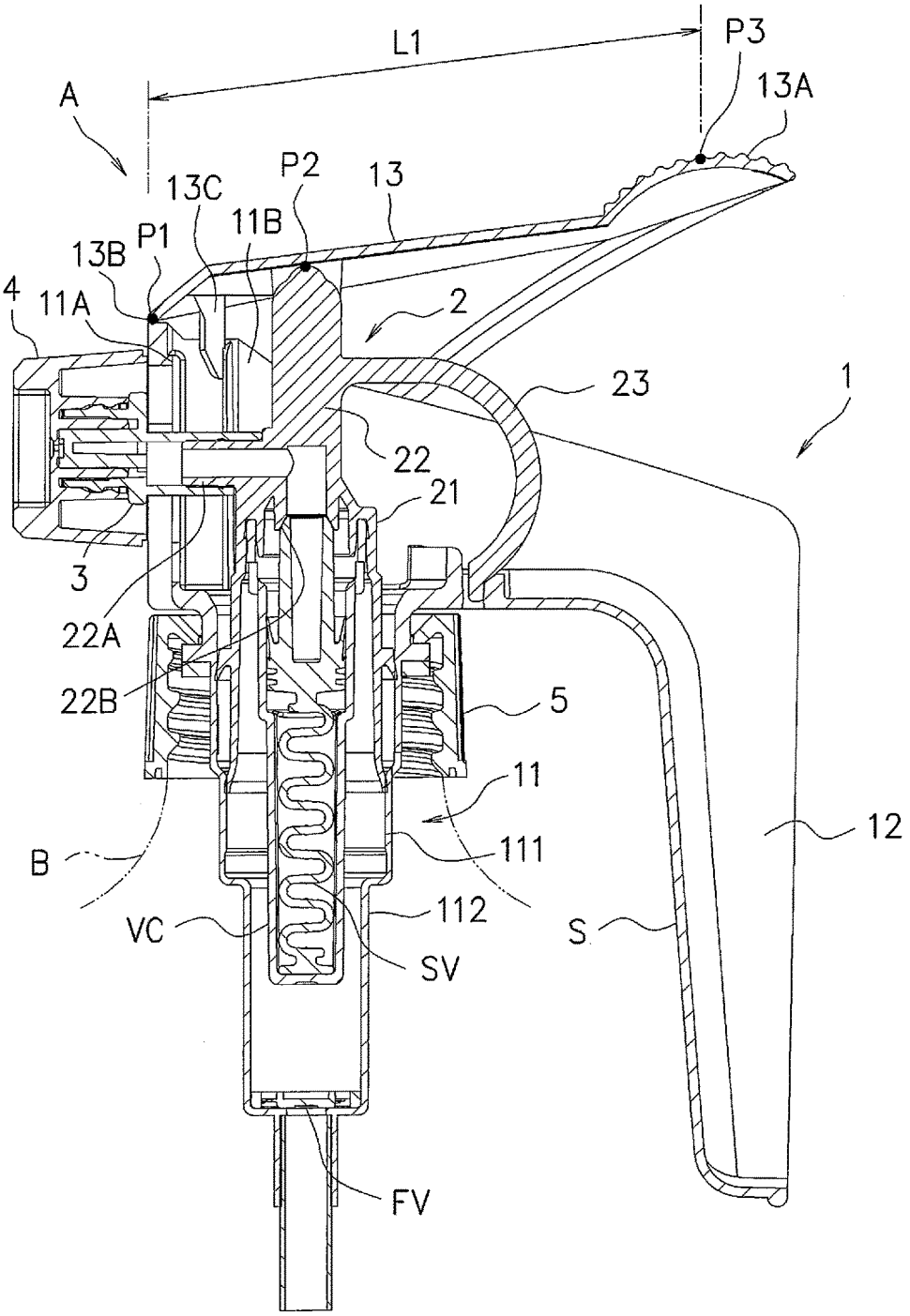
FIG. 3 is a cross-sectional view of a state in which a trigger section of the trigger-type pump dispenser of the present invention is to be depressed.

Further, FIG. 3 is a cross-sectional view of a state in which a trigger section of the trigger-type pump dispenser of the present invention is to be depressed.

The trigger-type pump dispenser A of the present invention includes a cylinder structure 1, a piston structure 2, a nozzle base section 3, the nozzle section 4, and a cap section 5.

The cylinder structure 1 integrally includes the cylinder section 11, the handle section 12, and the trigger section 13. The cylinder structure 1 also serves as a cover (i.e., a housing). The piston structure 2 integrally includes the piston section 21, a support section 22, and a plate spring section 23.

The nozzle base section 3 is attached to the piston structure 2, and the nozzle section 4 is attached to the nozzle base section 3.

Meanwhile, the trigger-type pump dispenser A includes two valves for opening and closing a liquid flow passage. One of the valves is a first valve FV located in a lower position, and the other of the valves is a second valve SV located in a higher position than the first valve FV.

It should be noted here that the valves are accumulator valves.

(Cylinder Structure)

First, the cylinder structure 1 is described.

The cylinder structure 1 includes the cylinder section 11, in which the piston section 21 slides, and the handle section 12, which projects backward from the cylinder section 11.

Moreover, the cylinder section 11 has an upright wall portion 11A rising upward from a front end portion of the cylinder section 11, and the trigger section 13 has a thin walled portion 13B via which the trigger section 13 extends from the upright wall portion 11A.

This allows the thin walled portion 13B to serve as a so-called "hinged portion" to allow the trigger section 13 to freely rotate.

The trigger section 13 has a thumb-placing portion 13A that occupies a given area at a back end portion of the trigger section 13, and in a case where the trigger section 13 is depressed with a thumb placed on the thumb-placing portion 13A, the thumb-placing portion 13A has a point of force P3 at its middle position.

The trigger section 13 has a substantially U-shaped cross-section that is open downward. As such, the trigger section 13 can cover at least a part of the periphery of the handle section 12.

Moreover, the trigger section 13 can also cover an upper portion of the after-mentioned piston stricture 2. As such, the trigger section 13 also serves as a cover (i.e., a housing).

This structure makes it possible to place the thin walled portion 13B in a backward position by placing the upright wall portion 11A in a backward position.

This offers an advantage in that even in a case where the distance L1 from the hinged portion 13B (fulcrum P1) to the thumb-placing portion 13A (point of force P3) is not sufficient, a high lever ratio can be ensured by minimizing the distance from the hinged portion 13B (fulcrum P1) to a point of action P2.

Meanwhile, the cylinder section 11 is in the shape of multiple cylinders having different diameters. The cylinder section 11 includes a large-diameter portion 111 and a small-diameter portion 112. The large-diameter portion 111 has a rib on the upper side, and the small-diameter portion 112 is located below the large-diameter portion 111.

It should be noted that the large-diameter portion 111 has its diameter reduced in an intermediate position.

The piston structure 21 slides up and down in the large-diameter portion 111 of the cylinder section 11.

The handle section 12, which is integrally included by the cylinder structure 1, extends downward in the shape of an L, and is formed in a place located on the same side as the trigger section 13 and directly below the trigger section 13.

The handle section 12 has a substantially U-shaped cross-section that is open downward. As such, the handle section 12 has side walls that can cover a partial region in the upper portion of the piston structure 2.

The handle section 12 is in a position to efficiently spray the liquid in cooperation with the trigger section 13 in spraying the liquid. This point will be described below.

The trigger-type pump dispenser A of the present invention makes it possible to hold up the thumb in gripping the handle section 12 and place the thumb on the trigger section 13, in particular the thumb-placing portion 13A, so that the trigger section 13 can be squeezed simply by depressing the trigger section 13 downward with the thumb while gripping the handle section 12 by getting four (or, for some people, three) fingers caught in the handle section 12.

This eliminates the need to grip the whole trigger-type pump dispenser A. The presence of the handle section 12 makes it possible to easily operate the trigger section 13 by utilizing the handle section 12. This allows even children with small hands and others to easily handle the trigger-type pump dispenser A.

In a case where the trigger section 13 is rotated by being depressed with the thin walled portion 13B (fulcrum P1) as a starting point, the trigger section 13 is stopped by coming into contact with a part of the handle section 12.

Further, the trigger section 13 rotates upward to return, but since the trigger section 13 has a locking portion 13C that extends downward from the trigger section 13 and engages with the upright wall portion 11, which extends upward from the cylinder structure 1, the upward rotation of the trigger section 13 is blocked at the point in time where the locking portion 13C engages with the upright wall portion 11A (top dead point).

(Piston Structure)

Next, the piston structure 2 is described.

The piston structure 2 integrally includes the piston section 21, which slides in the cylinder section, the support section 22, which projects toward a higher position than the piston section 21, and the plate spring section 23, which projects long backward from the support section 22.

Further, the support section 22 includes a projecting passage portion 22A that projects forward, and the nozzle base section 3 is attached to the projection passage portion 22A by being fitted onto the projection passage portion 22A.

Further, the nozzle section 4 (which also serves as a nozzle cap) is attached to the nozzle base section 3.

The support section 22 has a top surface in contact with a lower surface of the aforementioned trigger section 13, and serves as the point of action P2.

Therefore, rotating the trigger section 13 downward causes the support section 22, i.e., the piston structure 2, to move down.

A valve case VC is fitted in the piston section 21 of the piston structure 2, and the second valve SV is fitted in the valve case VC.

Further, the valve case VC has a hole formed on the side thereof.

The second valve SV has its upper end valving element normally in contact with a valve seat 22B formed below the support section.

This structure allows the second valve SV to fulfill a function of an accumulator valve.

It should be noted that the valve case VC (with the second valve SV fitted therein) is attached to the piston section 2 simply by being strongly press-fitted into the piston section 2 from underneath.

Note here that the second valve SV is structured to have a valving element and a spring section. However, a detailed description thereof is omitted.

Meanwhile, the cap 5 serves to attach the pump dispenser A to a container B. The cap 5 is attached to the container B, for example, by being screwed.

The cap 5 has an inward locking portion formed at an upper end portion thereof, and the cylinder structure 1 has a rib formed such that the locking portion engages with the rib.

Next, actuation of the trigger-type pump dispenser A is described.

Figure 4:
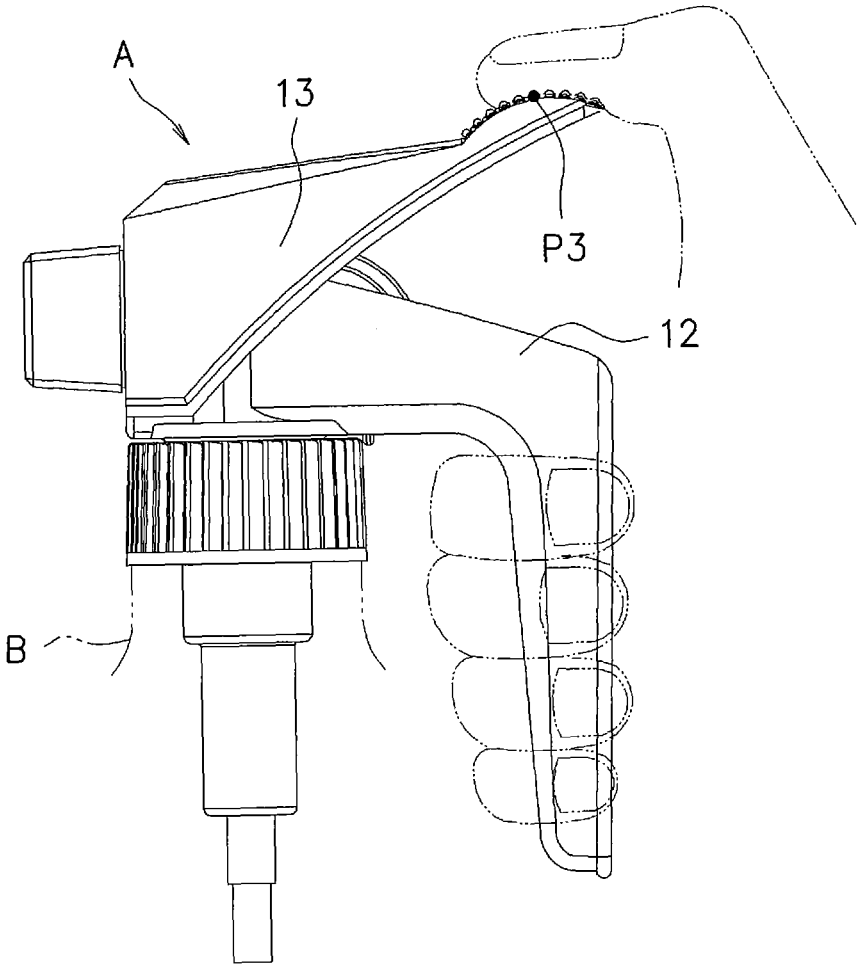
FIG. 4 is a diagram explaining a state in which the trigger-type pump dispenser of the present invention is being gripped.
Figure 5:
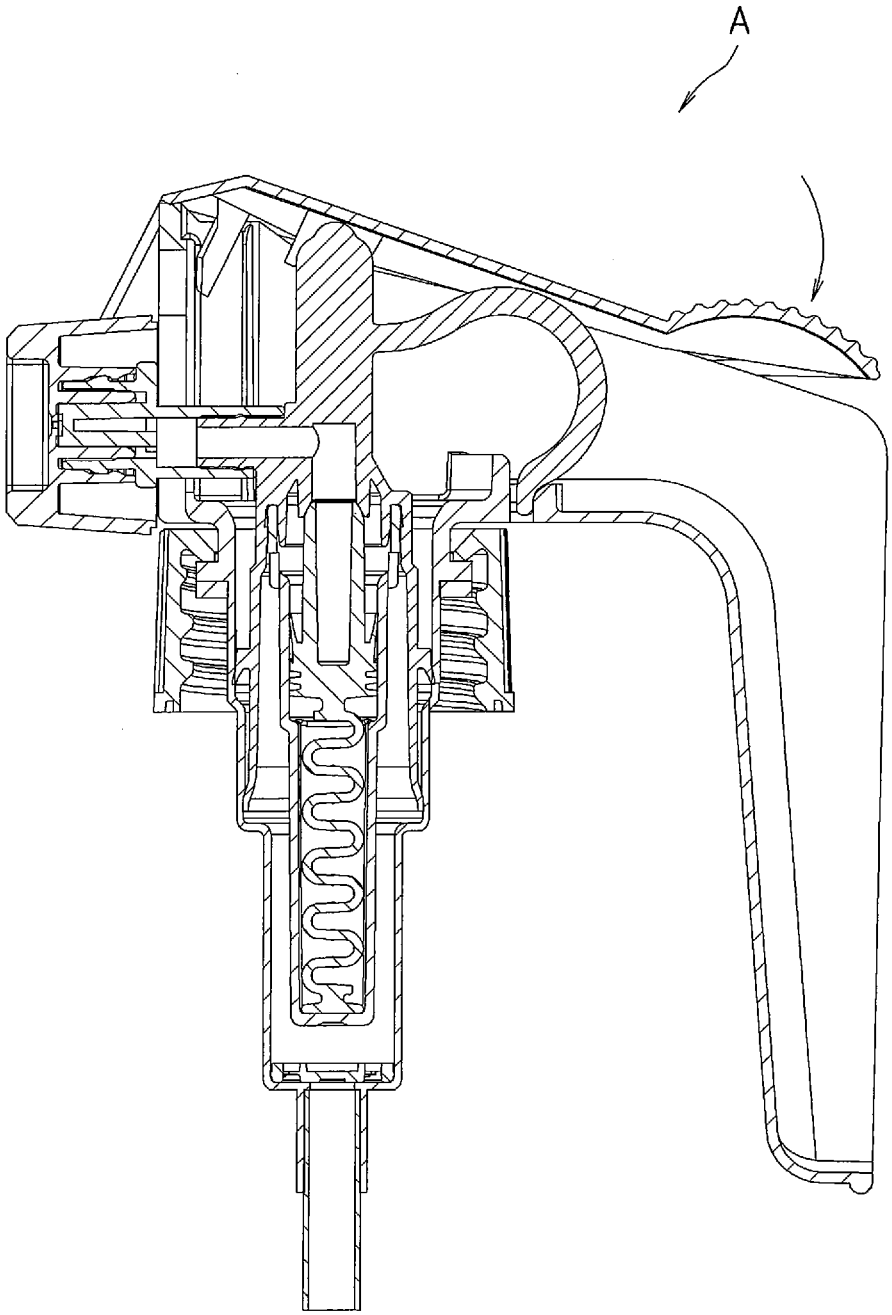
FIG. 5 is a cross-sectional view of a state in which a trigger section of the trigger-type pump dispenser of the present invention has been depressed.

FIG. 4 is a diagram explaining a state in which the trigger-type pump dispenser of the present invention is being gripped, and FIG. 5 is a cross-sectional view of a state in which the trigger section of the trigger-type pump dispenser of the present invention has been depressed.

As shown in FIG. 4, gripping the handle section 12 and the trigger section 13 and depressing the trigger section 13 downward causes the piston section 21 to move downward to raise the pressure of liquid in the cylinder section.

The rise in the pressure of liquid in the cylinder section causes the second valve SV to open (with the first valve FV closed), so that the cylinder section 11 communicates with the nozzle section 4 via the projecting passage portion 22A and the nozzle base section 3.

This causes the liquid to flow out from the cylinder section 11 to the nozzle base section 3 through the projecting passage portion 22A to be ejected from a nozzle opening of the nozzle section 4.

In this case, a downward movement of the piston section 21 lowers the nozzle opening in accordance with the downward movement of the trigger section 13, thus making it easy to aim at a target.

It should be noted that the trigger section 13 is depressed so that a portion thereof (not illustrated) stops upon contact with the handle section 12, and this position is the bottom dead point of the trigger section 13.

Further, when the pressing force from the trigger section 13 is released by losing hold of the trigger section 13, the returning force of the plate spring section 23 causes the piston section 21 to rise back to its original position with the second valve SV closed.

This causes a drop in the pressure in the cylinder section to cause the first valve FV to open (with the second valve SV closed at this point in time), so that the liquid is sucked out of the container's body into the cylinder section.

The upward return of the trigger section 13 is achieved by the spring force of the plate spring section 23, which is integrally included by the piston structure 2.

The plate spring section 23 always applies upward biasing force to the trigger section 13. Therefore, even when the trigger section 13 is depressed with the thumb put on the trigger section 13, releasing the thumb from the trigger section 13 allows the trigger section 13 to spontaneously return to its original position.

At this point in time, the locking portion 13C of the trigger section 13 engages with a locking portion 11B of the cylinder structure 1 to block the upward rotation of the trigger section 13 (top dead point).

As mentioned above, at the bottom dead point, the trigger section 13 covers the side walls of the handle section 12 (see FIG. 2).

This causes side walls of the trigger section 13 to move up and down along the side walls of the handle section 12 in the process of movement. This allows the trigger section 13 to stably move without swinging from side to side.

It should be noted that the decrease in the amount of liquid in the container's body makes the pressure in the container's body negative to cause a depression in the container, and the trigger-type pump dispenser A includes negative-pressure eliminating means (not illustrated) for eliminating such negative pressure.

As mentioned above, in the trigger-type pump dispenser A of the present invention, the handle section 12 is located below the trigger section 13. This eliminates the need to grip the whole pump dispenser in squeezing the trigger section 13 to spray the liquid.

As shown in FIG. 4, this makes it only necessary to depress the trigger section 13 by putting the thumb on the thumb-placing portion 13A with four (or, for some people, two or three) fingers caught in the handle section 12.

This allows even children with small hands and others to easily handle the trigger-type pump dispenser A.

Furthermore, this prevents the hand from being soiled with a liquid chemical, if any, adhering to the pump dispenser per se, as the hand is away from the pump dispenser's body.

(Feature 1)

Furthermore, a positional relationship between the handle section 12 and the trigger section 13, which have been described above, is described.

According to the present invention, the handle section 12 has a forward-inclined portion (referred to as "finger contact portion S") with which the fingers of a gripper come into contact.

The forward inclination of the finger contact portion S causes the thumb to be inclined forward, too, when the handle section 12 is gripped with fingers placed thereon.

The forward inclination of the thumb makes it possible to easily put the thumb on the trigger section 13 and, at the same time, makes it easy to squeeze the trigger section 13.

Furthermore, in a case where the handle section 12 is gripped, the inclined surface of the finger contact portion S generates a component force that disperses the force of gravity of the trigger-type pump dispenser A, thus making it easy to support the trigger-type pump dispenser A.

This is effective in supporting the weight of the whole container including the trigger-type pump dispenser A.

Experiments on the validity of this point will be described below.

(Feature 2)

Further, according to the present invention, all of the finger contact portion S is located posterior to (lateral to) the point of force P3 of the trigger section 13.

Since the finger contact portion S is located posterior to (lateral to) the point of force P3, gripping the handle section 12 and placing the thumb on the thumb-placing portion 13A causes the thumb to be inclined forward, thus making it possible to easily perform an operation of pressing in the direction that the thumb is supposed to be bent.

This puts no strain on the usage of fingers and allows efficient transmission of finger pressure.

It should be noted that the thumb-placing portion 13A has a large number of transverse linear projections formed thereon to allow force to be extremely effectively transmitted in a case where the trigger section 13 is squeezed with the thumb.

That is, specifically, from the state of being held up with the handle section 12 gripped, the thumb is inclined forward to be placed on the thumb-placing portion 13 (point of force P3) of the trigger section.

It should be noted that the thumb-placing portion 13A is a region in a part of the back end portion of the trigger section 13 and is also exactly a portion on which the ball of the thumb is placed.

The so-called point of force P3 can be said to correspond to the intermediate position of the thumb-placing portion 13A.

This makes it only necessary to depress the trigger section 13 with the thumb in the direction that the thumb bends.

Incidentally, when the finger contact portion S is located anterior to (medial to) the point of force P3 of the trigger section 13, it is necessary to get the thumb caught in the thumb-placing portion 13A by holding up the thumb posterior to a position directly above it while gripping the handle section 12.

Thus, getting the thumb caught in the trigger section 13 requires a first stage at which the thumb is deflected in a direction opposite to the direction that the thumb is supposed to bent, thus putting strain on the fingers in terms of joint function.

In squeezing the trigger section 13 at a second stage that follows, the trigger section 13 is depressed with the thumb kept deflected. This makes it difficult to perform the squeezing operation.

Normally, from the viewpoint of the grip stability with which the handle section 12 is gripped and the thumb is brought into contact with the trigger section 13, it is preferable that the distance L between the trigger section 13 and the handle section 12 be 35 mm to 45 mm.

Experimental Example 1

As an experimental example of Feature 1 described above, an experiment was conducted with varying angles of forward inclination θ of the finger contact portion S of the handle section 12.

Figure 6:
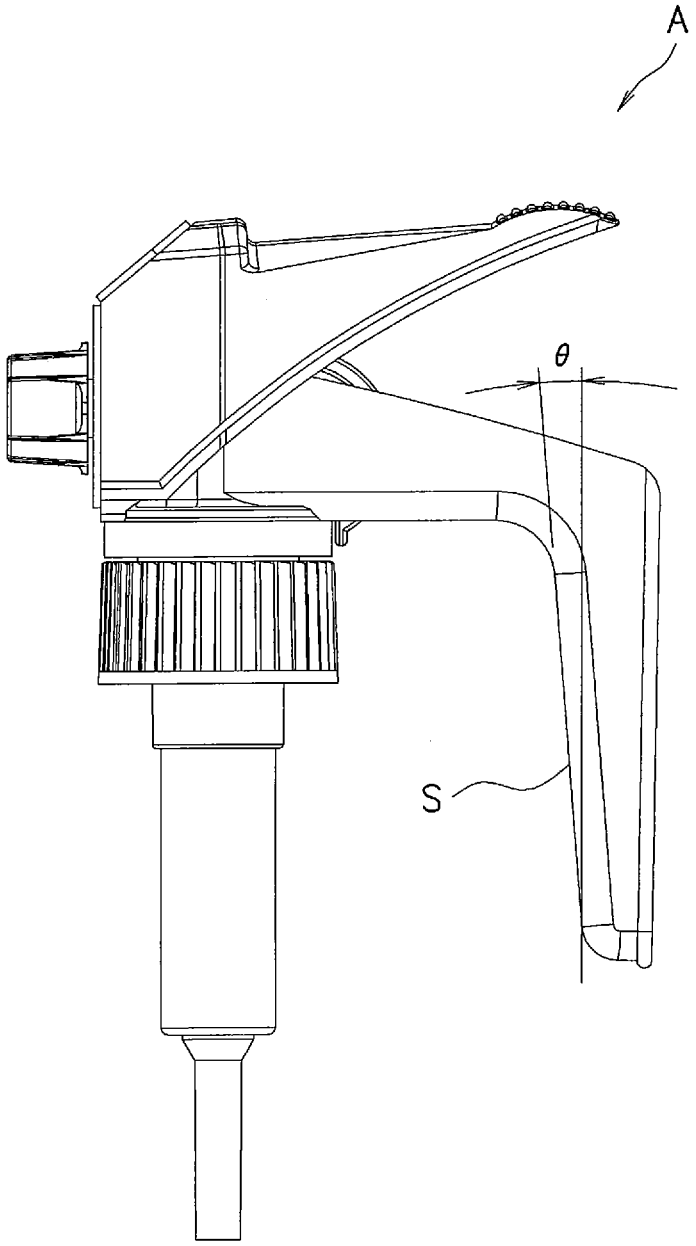
FIG. 6 shows a trigger-type pump dispenser on which a panel test of Experiment 1 was conducted.

A panel test was conducted on a trigger-type pump dispenser A shown in FIG. 6 with varying angles of inclination θ of the finger contact portion S.

The panel test was conducted on a total of 43 randomly selected general adult males and females of standard proportions to assess the operability of the trigger-type pump dispenser A with varying angles of inclination of 1 degree, 2 degrees, 3 degrees, 4 degrees, 5 degrees, 6 degrees, 7 degrees, 8 degrees, 9 degrees, 10 degrees, 11 degrees, and 12 degrees of the finger contact portion S.

It should be noted that the other dimensions are as illustrated.

An evaluation was carried out on the basis of the following five-level rating system: Easy to operate in depressing the trigger section (◎); Slightly easy to operate in depressing the trigger section (○); Hard to say whether it is easy or difficult to operate in depressing the trigger section (Δ); Slightly hard operate in depressing the trigger section (□); and Hard to operate in depressing the trigger section (X).

FIG. 7 shows the results, which show that from the viewpoint of operability, excellence was exhibited when the inclination θ of the inclined part of the finger contact portion S fell within the range of 3 degrees to 10 degrees.

Similar experiments were conducted with varying dimensions of the body and exhibited similar tendencies.

Experimental Example 2

Figure 8C:
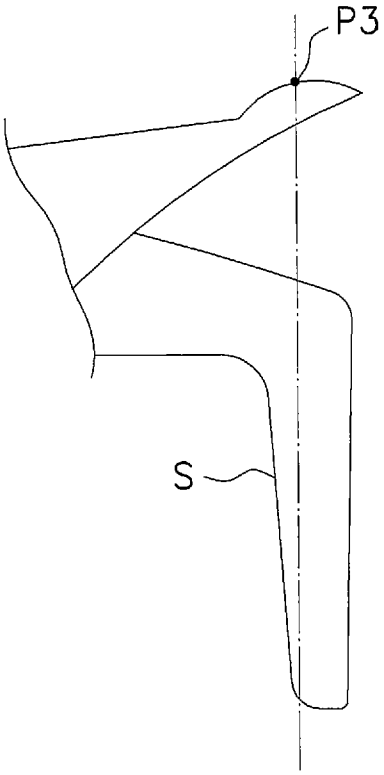
FIG. 8 shows a trigger-type pump dispenser on which a panel test of Experiment 2 was conducted.
Figure 8B:
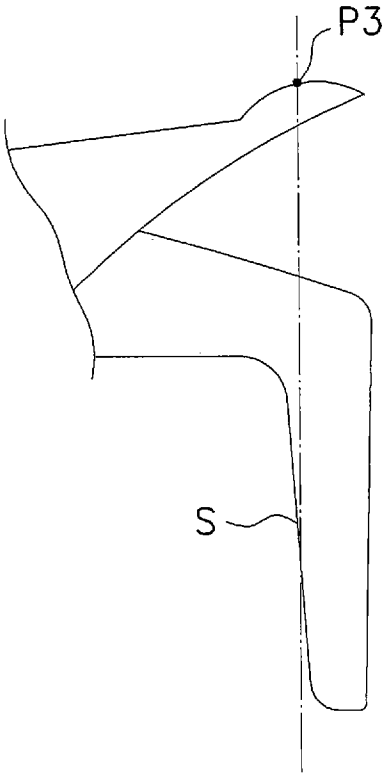
Figure 8A:
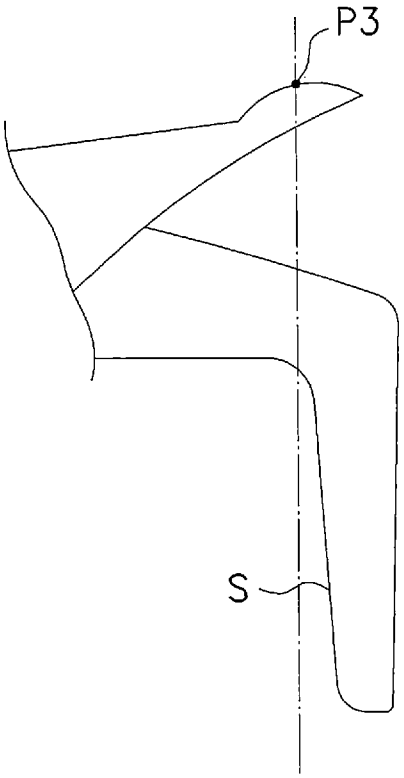

An experiment was conducted on the operability of trigger-type pump dispensers A shown in (A), (B), and (C) of FIG. 8.

The dimensions are as shown in FIG. 6. The finger contact portions S employed have an angle of inclination θ of 5 degrees. (A), (B), and (C) differ from each other in terms of the positions of the handle sections.

A panel test was conducted on a total of 43 randomly selected general adult males and females of standard proportions in each of the cases of (A), (B), and (C).

An evaluation was carried out in each of the cases of (A), (B), and (C) by each person performing an operation of depressing the trigger section 13 with the thumb while gripping the handle section.

The evaluation was carried out on the basis of the following five-level rating system: Easy to operate in depressing the trigger section 13 (◎); Slightly easy to operate in depressing the trigger section 13 (○); Hard to say whether it is easy or difficult to operate in depressing the trigger section 13 (Δ); Slightly hard operate in depressing the trigger section 13 (□); and Hard to operate in depressing the trigger section 13 (X).

FIG. 9 shows the results, which show that the operability is excellent in the case (A) where all of the finger contact portion S is located posterior to (lateral to) the point of force P3 of the trigger section 13.

The first embodiment, which has been described above, is an example in which the trigger-type pump dispenser A is provided with the handle section 12. Alternatively, the container B, which is a separate member, may be provided with the handle section 12.

That is, as in the aforementioned first embodiment, the positional relationship between a handle section 12A and a trigger section 13 and the validity of the angle of inclination of the finger contact portion S of the handle section 12A are also applicable to a second embodiment, which is described next.

Second Embodiment

Figure 10:
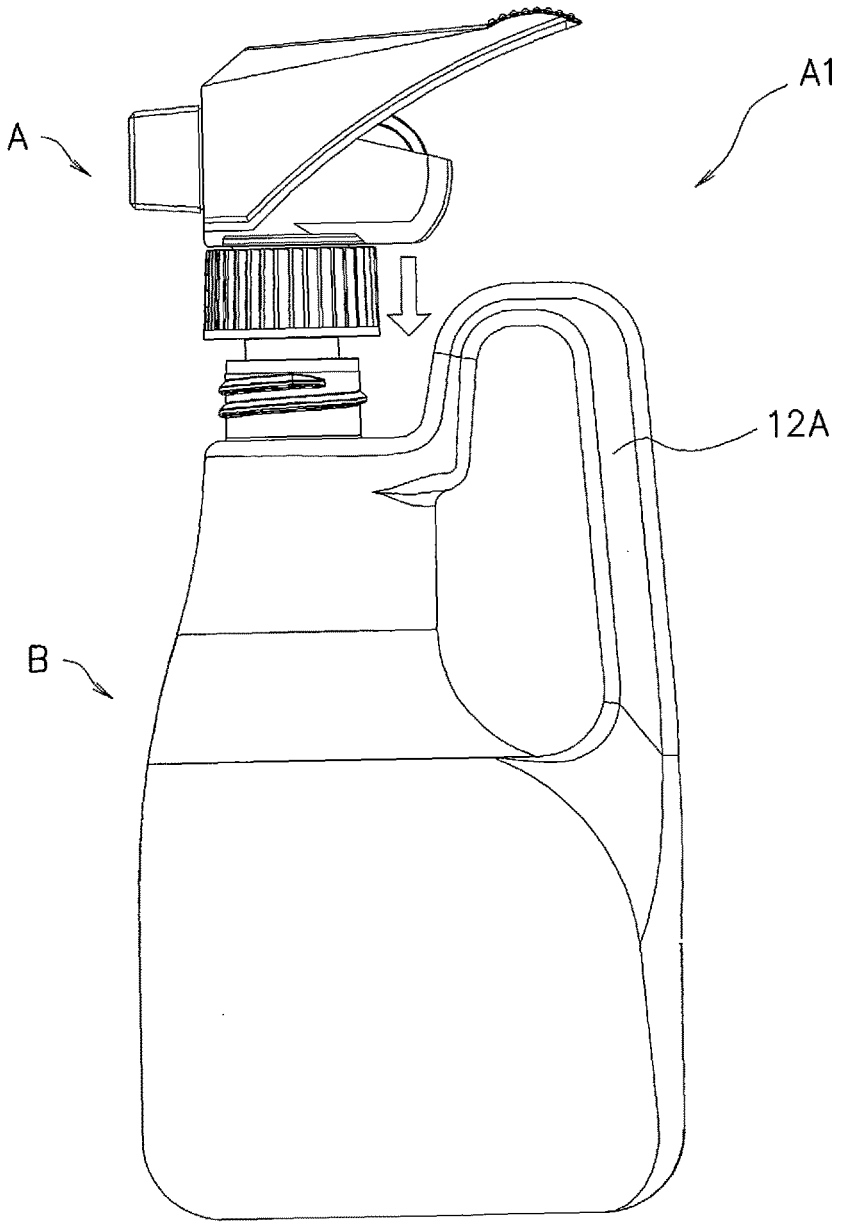
FIG. 10 is a diagram showing a container-equipped trigger-type pump dispenser in a state where the trigger-type pump dispenser is to be attached to the mouth of the container.

FIG. 10 is a diagram showing a container-equipped trigger-type pump dispenser A1 in a state where the trigger-type pump dispenser A is to be attached to the mouth of the container B.

Figure 11:
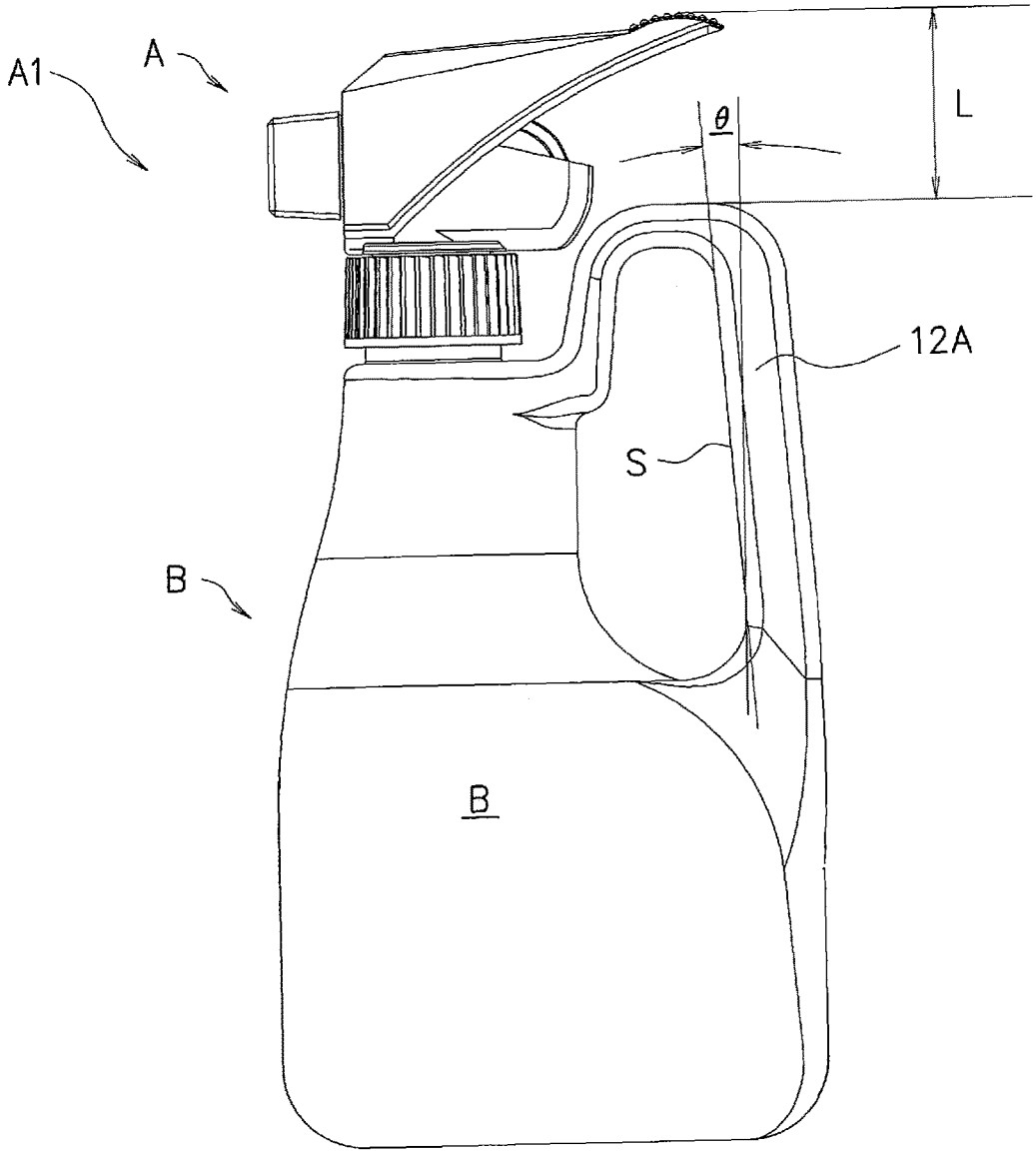
FIG. 11 is a diagram showing the container-equipped trigger-type pump dispenser in a state where the trigger-type pump dispenser has been attached to the mouth of the container.

FIG. 11 is a diagram showing the container-equipped trigger-type pump dispenser A1 in a state where the trigger-type pump dispenser A has been attached to the mouth of the container B.

Figure 12:
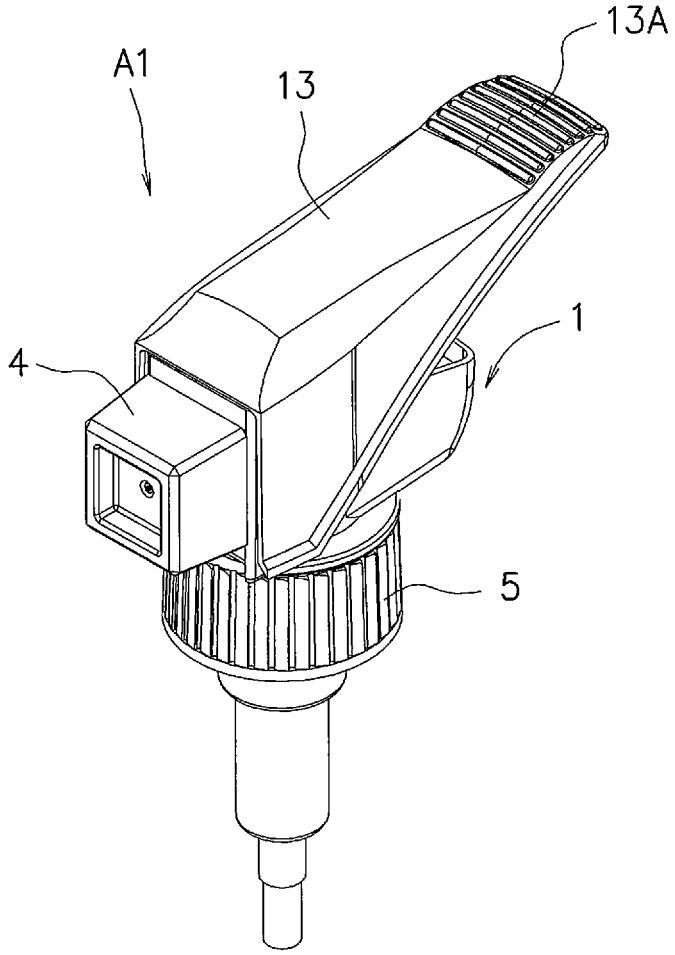
FIG. 12 is a perspective view of a trigger-type pump dispenser that is attached to a container.

Further, FIG. 12 is a perspective view of a trigger-type pump dispenser A that is attached to a container.

Figure 13:
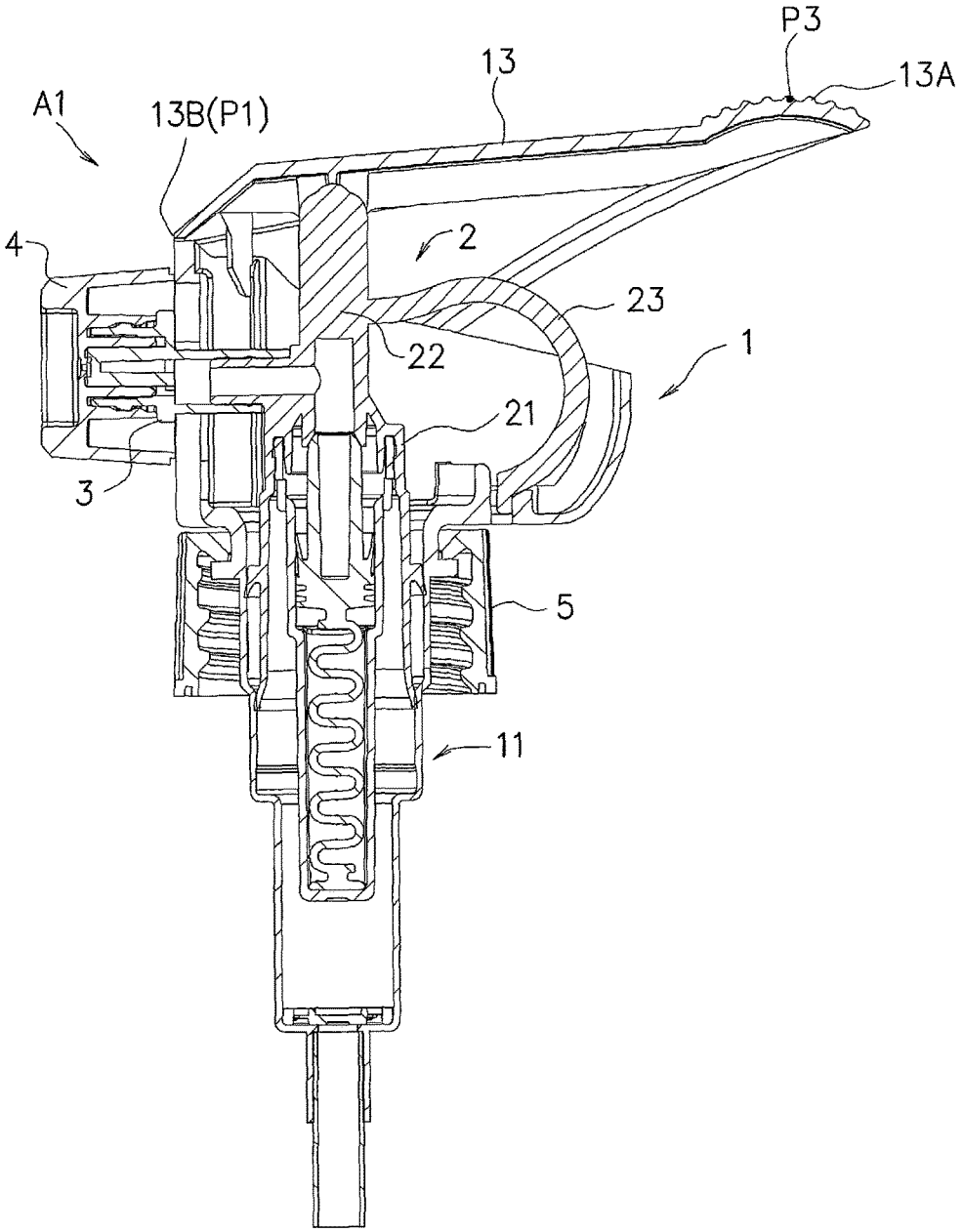
FIG. 13 is a cross-sectional view of the trigger-type pump dispenser that is attached to a container.

FIG. 13 is a cross-sectional view of the trigger-type pump dispenser A that is attached to a container.

The container-equipped trigger-type pump dispenser A1 includes: a container B provided with a handle section 12A; a cylinder section; a trigger section 13 located above the handle section 12A; and a nozzle section 4 from which liquid is sprayed out of the cylinder section by depressing the trigger section 13 with the handle section 12A gripped.

The container-equipped trigger-type pump dispenser A1 further includes: a cylinder structure 1; a piston structure 2 that freely slides in the cylinder section; a nozzle base section 3; the nozzle section 4; and a cap section 5.

The cylinder structure 1 integrally includes the cylinder section 11 and the trigger section 13, and the piston structure 2 integrally includes a piston section 21, a support section 22, and a plate spring section 23.

Incidentally, in the trigger-type pump dispenser A according to the aforementioned first embodiment, a handle section is further integrated with the cylinder structure 1.

By depressing the trigger section 13 toward the handle section 12A, the piston section 21 is depressed to apply pressure into the cylinder section to eject liquid through the nozzle section 4.

(Feature 1)

The handle section 12A of the container-equipped trigger-type pump dispenser A1, too, has a forward-inclined portion (referred to as "finger contact portion S") with which the fingers of a gripper come into contact (see the angle of inclination θ in FIG. 11).

Therefore, in a state where the handle section 12A is gripped with the fingers placed thereon, the thumb is necessarily inclined forward. This makes it possible to easily put the thumb on the trigger section 13 and, at the same time, makes it easy to squeeze the trigger section 13. This also makes it easy to support the whole weight including the container B.

(Feature 2)

In the container-equipped trigger-type pump dispenser A1, too, all of the handle section 12A of the container B is located posterior to (lateral to) the point of force P3 of the trigger section 13 of the container-equipped trigger-type pump dispenser A1.

Therefore, gripping the handle section 12A and placing the thumb on the thumb-placing portion 13A causes the thumb to be inclined forward, thus making it possible to perform an operation of pressing in the direction that the thumb is supposed to be bent.

This puts no strain on the usage of fingers and allows efficient transmission of finger pressure. Features 1 and 2 described above of the container-equipped trigger-type pump dispenser A1, too, were verified by conducting experiments that are similar to those of the aforementioned first embodiment.

As a result, similar evaluation results were obtained.

That is, it was found that from the viewpoint of operability, excellence was exhibited when the inclination θ of the inclined part of the finger contact portion S fell within the range of 3 to 10 degrees, and that the operability is excellent in the case (A) where all of the finger contact portion S is located posterior to (lateral to) the point of force P3 of the trigger section 13.

Normally, as in the aforementioned first embodiment, from the viewpoint of the grip stability with which the handle section 12A is gripped and the thumb is brought into contact with the trigger section 13, it is preferable that the distance L between the trigger section 13 and the handle section 12A be 35 mm to 45 mm.

The present invention has been described by taking an embodiment thereof as an example. However, the present invention is not limited to the embodiment described above, but may be modified in various ways.

The trigger-type pump dispenser can be adopted without being limited to an accumulator type. Further, attaching a publicly-known orifice or foam maker to the tip of the nozzle section makes it possible to choose to eject liquid in the form of a mist or a foam.

Further, the trigger-type pump dispenser can be used for containers for storing liquid such as cosmetics, liquid detergents, laundry auxiliary agents, softeners, shampoos, body soaps, dishwashing detergents.

INDUSTRIAL APPLICABILITY

The present invention is directed to a trigger-type pump dispenser which has a piston section that hardly swings, which has low sliding resistance, and which is easy for people with small hands to handle.

As such, the trigger-type pump dispenser is applicable to the field of industries in general for painting, medical instruments, or the like.

REFERENCE SIGNS LIST

1 . . . cylinder structure
11 . . . cylinder section
11A . . . upright wall portion
11B . . . locking portion
111 . . . large-diameter portion
112 . . . small-diameter portion
12 . . . handle section
12A . . . handle section
13 . . . trigger section
13A . . . thumb-placing portion
13B . . . thin walled portion (hinged portion)
13C . . . locking portion
2 . . . piston structure
21 . . . piston section
22 . . . support section
22A . . . projecting passage portion
22B . . . valve seat
23 . . . plate spring section
3 . . . nozzle base section
4 . . . nozzle section
5 . . . cap section
A . . . trigger-type pump dispenser
A1 . . . container-equipped trigger-type pump dispenser
B . . . container
S . . . finger contact portion
FV . . . first valve
SV . . . second valve
VC . . . valve case
P1 . . . fulcrum
P2 . . . point of action
P3 . . . point of force

The invention claimed is:

1. A trigger-type pump dispenser comprising:
a cylinder section;
a handle section;
a trigger section located above the handle section; and
a nozzle section from which liquid is sprayed out of the cylinder section by depressing the trigger section with the handle section gripped,
wherein the handle section has a finger contact portion located posterior to a point of force of the trigger section,
the trigger-type pump dispenser further comprises:
a cylinder structure;
a piston structure that freely slides in the cylinder section;
a nozzle base section;
the nozzle section; and
a cap section,
wherein the cylinder structure integrally includes the cylinder section, the trigger section, and the handle section,
the piston structure integrally includes a piston section, a support section, and a plate spring section, and
by depressing the trigger section toward the handle section, the piston section is depressed to apply pressure into the cylinder section to eject liquid through the nozzle section.

2. The trigger-type pump dispenser according to claim 1, wherein the finger contact portion of the handle section has an angle of inclination of 3 degrees to 10 degrees.

3. The trigger-type pump dispenser according to claim 2, wherein the handle section and the trigger section are placed at a distance of 35 mm to 45 mm from each other.

4. The trigger-type pump dispenser according to claim 1, wherein the handle section and the trigger section are placed at a distance of 35 mm to 45 mm from each other.

5. A container-equipped trigger-type pump dispenser comprising:
a container provided with a handle section;
a cylinder section;
a trigger section located above the handle section; and
a nozzle section from which liquid is sprayed out of the cylinder section by depressing the trigger section with the handle section gripped,
wherein the handle section has a finger contact portion located posterior to a point of force of the trigger section,
the container-equipped trigger-type pump dispenser further comprises:
a cylinder structure;
a piston structure that freely slides in the cylinder section;
a nozzle base section;
the nozzle section; and
a cap section,
wherein the cylinder structure integrally includes the cylinder section and the trigger section,
the piston structure integrally includes a piston section, a support section, and a plate spring section, and
by depressing the trigger section toward the handle section, the piston section is depressed to apply pressure into the cylinder section to eject liquid through the nozzle section.

6. The container-equipped trigger-type pump dispenser according to claim 5, wherein the finger contact portion of the handle section has an angle of inclination of 3 degrees to 10 degrees.

7. A trigger-type pump dispenser, comprising:

a cylinder section;

a handle section;

a trigger section located above the handle section; and a nozzle section from which liquid is sprayed out of the cylinder section by depressing the trigger section with the handle section gripped, wherein the handle section has a finger contact portion located posterior to a point of force of the trigger section, the trigger-type pump dispenser further comprises:

a cylinder structure;

a piston structure that freely slides in the cylinder section;

a nozzle base section;

the nozzle section; and a cap section, wherein the piston structure integrally includes a piston section, a support section, and a plate spring section, and by depressing the trigger section toward the handle section, the piston section is depressed to apply pressure into the cylinder section to eject liquid through the nozzle section.

* * * * *